US005363655A

United States Patent [19]

Kikkawa et al.

[11] Patent Number: 5,363,655

[45] Date of Patent: Nov. 15, 1994

[54] METHOD FOR LIQUEFYING NATURAL GAS

[75] Inventors: Yoshitsugi Kikkawa; Osamu Yamamoto; Junichi Sakaguchi; Moritaka Nakamura, all of Kanagawa, Japan

[73] Assignee: Chiyoda Corporation, Kanagawa, Japan

[21] Appl. No.: 28,025

[22] Filed: Mar. 8, 1993

[30] Foreign Application Priority Data

Nov. 20, 1992 [JP] Japan ..... 4-335540

[51] Int. Cl.[5] ..... F25J 1/00

[52] U.S. Cl. ..... 62/9; 62/23; 62/39

[58] Field of Search ..... 62/9, 23, 39

[56] References Cited

U.S. PATENT DOCUMENTS 4,229,195 10/1980 Forg ..... 62/23
4,256,476 3/1981 Van Baush ..... 62/23
4,303,427 12/1981 Krieger ..... 62/23
4,619,679 10/1986 DeLong ..... 62/39

*Primary Examiner*—Ronald C. Capossela
*Attorney, Agent, or Firm*—Skjerven, Morrill, MacPherson, Franklin & Friel

[57] ABSTRACT

Provided is a method for liquefying natural gas which can be readily adapted to LNG plants of all sizes without requiring expensive and special heat exchangers. The liquefaction of feed gas of natural gas and recycle natural gas is carried out with a single-component refrigerant or a mixed refrigerant in a high temperature stage, and with a substantially isentropic expansion in a low temperature stage, and a non-liquefied part of the recycle gas after the expansion step is pressurized with a compressor and recycled along with a recycle stream of non-liquefied par of the feed natural gas, the liquefied part by the refrigerant exchanging heat with the non-liquefied part stream produced from the substantially isentropic expansion, in a plate-fin heat exchanger or the like. The compressor is driven by the power obtained by the substantially isentropic expansion.

12 Claims, 12 Drawing Sheets

METHOD FOR LIQUEFYING NATURAL GAS

TECHNICAL FIELD

The present invention relates to a method for liquefying natural gas suitable for small LNG plants located in remote areas and LNG plants constructed in off-shore sites, and in particular to a method for liquefying natural gas which is improved over the conventional pre-cooled mixed refrigerant process. This method can be used over a wide range of LNG plants without requiring any Humpson type heat exchanger which is heavy and requires a long time for fabrication because special production technology is required.

BACKGROUND OF THE INVENTION

The natural gas liquefaction processes currently employed in base load LNG plants include the propane pre-cooled mixed refrigerant process developed by Air Products and Chemicals, Inc. of the United States, and the TEALARC process developed by Technip of France. However, in both cases, either propane or a mixture of propane and ethane is used for the pre-cooling of the natural gas (to approximately −40° C.), and the final cooling step (from −140° C. to −160° C.) is carried out with a refrigeration cycle of a mixed refrigerant (a mixture of nitrogen, methane, ethane and propane) using a huge Humpson type heat exchanger. In a Humpson heat exchanger, a multiplicity of turns of aluminum tube are wound around a core rod, and a LNG plant with an annual output of 1.0 million tons typically requires a huge Humpson type heat exchanger which is 50 m tall, weighing 100 tons.

Such a heat exchanger is extremely heavy due to its structural features. Further, since an extremely long time is required to have such a heat exchanger fabricated and fabrication requires a plant equipped with special facilities for complicated fabrication processes, the cost for constructing a LNG plant is thereby increased, especially for small or off-Shore LNG plants.

BRIEF SUMMARY OF THE INVENTION

In view of such problems of the prior art, a primary object of the present invention is to provide an improved method for liquefying natural gas which can be readily adapted to a LNG plant of any size without requiring any special heat exchangers.

A second object of the present invention is to provide a method for liquefying natural gas featuring a high power efficiency.

A third object of the present invention is to provide a method for liquefying natural gas which can be relatively inexpensively implemented.

According to the present invention, these and other objects of the present invention can be accomplished by providing a method for liquefying natural gas, comprising the steps of: cooling feed natural gas with a refrigerant in a first feed gas stage; cooling a non-liquefied part of the feed gas with a substantially isentropic expansion in a second feed gas stage following the first feed gas stage; pressurizing and recycling a non-liquefied part of the natural gas after the expansion in the second feed gas stage by using a first compressor; cooling a non-liquefied part of the recycle natural gas with a refrigerant in a first recycle gas stage; cooling a non-liquefied part of the recycle natural gas with a substantially isentropic expansion in a second recycle gas stage following the first recycle gas stage; and recovering liquefied parts of the feed natural gas and the recycle natural gas; the first compressor being driven at least partly by power obtained by at least one of the substantially isentropic expansion steps. Preferably, the cooling steps using a refrigerant are at least in most part carried out by using a common plate-fin heat exchanger.

The first stage and the second stage for cooling the feed natural gas and the recycle natural gas typically consist of cooling the natural gas from the ambient temperature to approximately −80° C., and from approximately −80° C. to approximately −160° C., which is the normal final temperature of the liquefied natural gas.

It is generally preferred that the method of the present invention further includes the step of exchanging heat between a part of the feed natural gas liquefied by the refrigerant in the first feed natural gas stage and a non-liquefied part of the feed natural gas after the substantially isentropic expansion in the second feed natural gas stage, and/or the step of exchanging heat between a part of the recycle natural gas liquefied by the refrigerant in the first recycle natural gas stage and a non-liquefied part of the recycle natural gas after the substantially isentropic expansion in the second recycle natural gas stage. However, when the recycle natural gas is under a super-critical pressure, such a step of heat exchange is unnecessary because the refrigerant would not cause any partial liquefaction of the natural gas.

In particular, by appropriately determining the output pressures of the substantially isentropic expansion for the feed natural gas and the recycle natural gas, the recycle compressors for the feed natural gas and the recycle natural gas may consist of one and the same compressor.

If the pressure of the recycled stream of the natural gas is approximately equal to the supply pressure of the feed natural gas, the expanders for the substantially isentropic expansion of the feed natural gas and the recycle natural gas may again consist of one and the same expander.

Further, a substantial saving of power can be accomplished by using an inter-cooler when compressing the single-component or mixed refrigerant, compressing the refrigerant partially liquefied and separated by the inter-cooler, and introducing the refrigerant into an after-cooler along with the stream from the compressor of the refrigerant.

A favorable refrigeration cycle can be attained according to a preferred embodiment of the present invention, wherein the composition (mol %) of the refrigerant is

| | |
|---|---|
| $N_2$ | 0–10 |
| $C_1$ | 7–60 |
| $C_2$ | 25–80 |
| $C_3$ | 3–20 |
| $C_4$ | 7–30 |
| $C_5$ | 7–30, |

the method further comprising the steps of: circulating the mixed refrigerant in a closed loop with a compressor, partly liquefying the thus pressurized refrigerant with an after-cooler, separating the thus partly liquefied refrigerant with a separation drum to produce a gas refrigerant fraction and a first liquid refrigerant fraction, and passing these fractions in separate paths of a heat exchanger cooled by a low pressure mixed refrigerant; liquefying the gas fraction in the heat exchanger to produce a second liquid refrigerant fraction, and passing it through an expansion valve or an expansion drum so as to convert it into a low-temperature, low-pressure mixed refrigerant; passing the low-temperature, low-pressure mixed refrigerant through the heat exchanger in a direction opposite to that of the gas refrigerant fraction mixing the low-temperature, low-pressure mixed refrigerant with the first liquid refrigerant fraction and flowing the combined mixed refrigerant in a direction opposite to that of the gas refrigeration fraction and recycling the combined refrigerant to the compressor.

Thus, according to the present invention, by conducting the step of pre-cooling with a relatively inexpensive heat exchanger such as a plate-fin heat exchanger using a mixed refrigerant or the like for cooling the natural gas to −60° C. to −100° C., and the step of final cooling (−140° C. to −160° C.) with an expansion cycle in a turbo expander or the like, the need for a huge Humpson heat exchange can be eliminated. In this case, it is important in view of saving power consumption to partially liquefy the natural gas by the pre-cooling step, and cooling the liquefied part of the natural gas to a level comparable to that at the outlet of the turbo expander by exchanging heat between the part of the natural gas liquefied by the refrigerant and the gas separated in a drum at the outlet end of the turbo expander so as to reduce the amount of flow that is to be recycled through the turbo expander. This method is advantageous for small plants, but may also be beneficial for large plants which require a Humpson heat exchanger larger than technically possible.

BRIEF DESCRIPTION OF THE DRAWINGS

The preferred embodiments of the present invention are described in the following with reference to the appended drawings, in which.

DETAILED DESCRIPTION OF THE PREFERRED EMBODIMENTS

Figure 1:
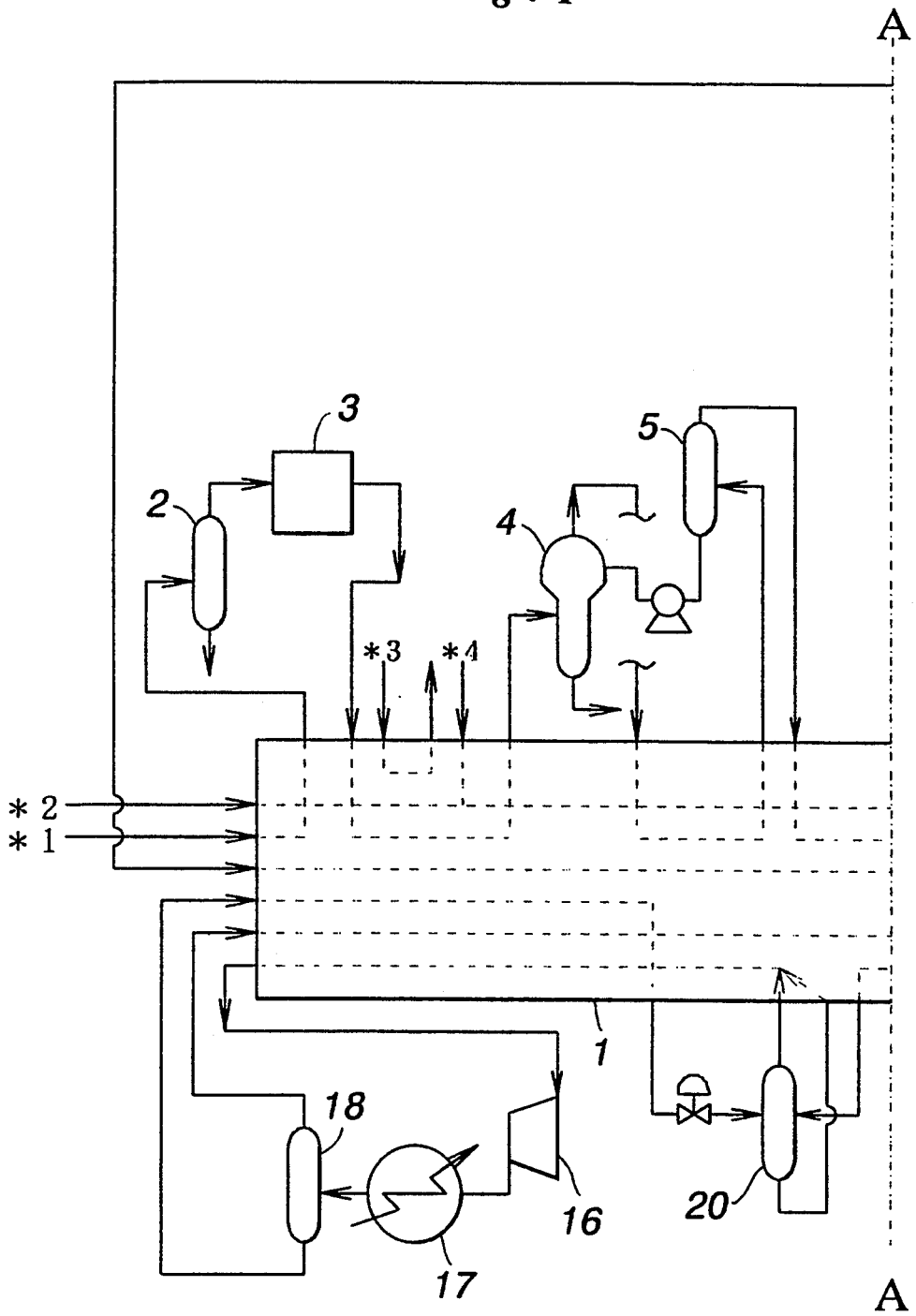
FIG. 1 is a diagram showing one half of a plant which is suitable for applying a first embodiment of the method for liquefying natural gas according to the present invention.
Figure 2:
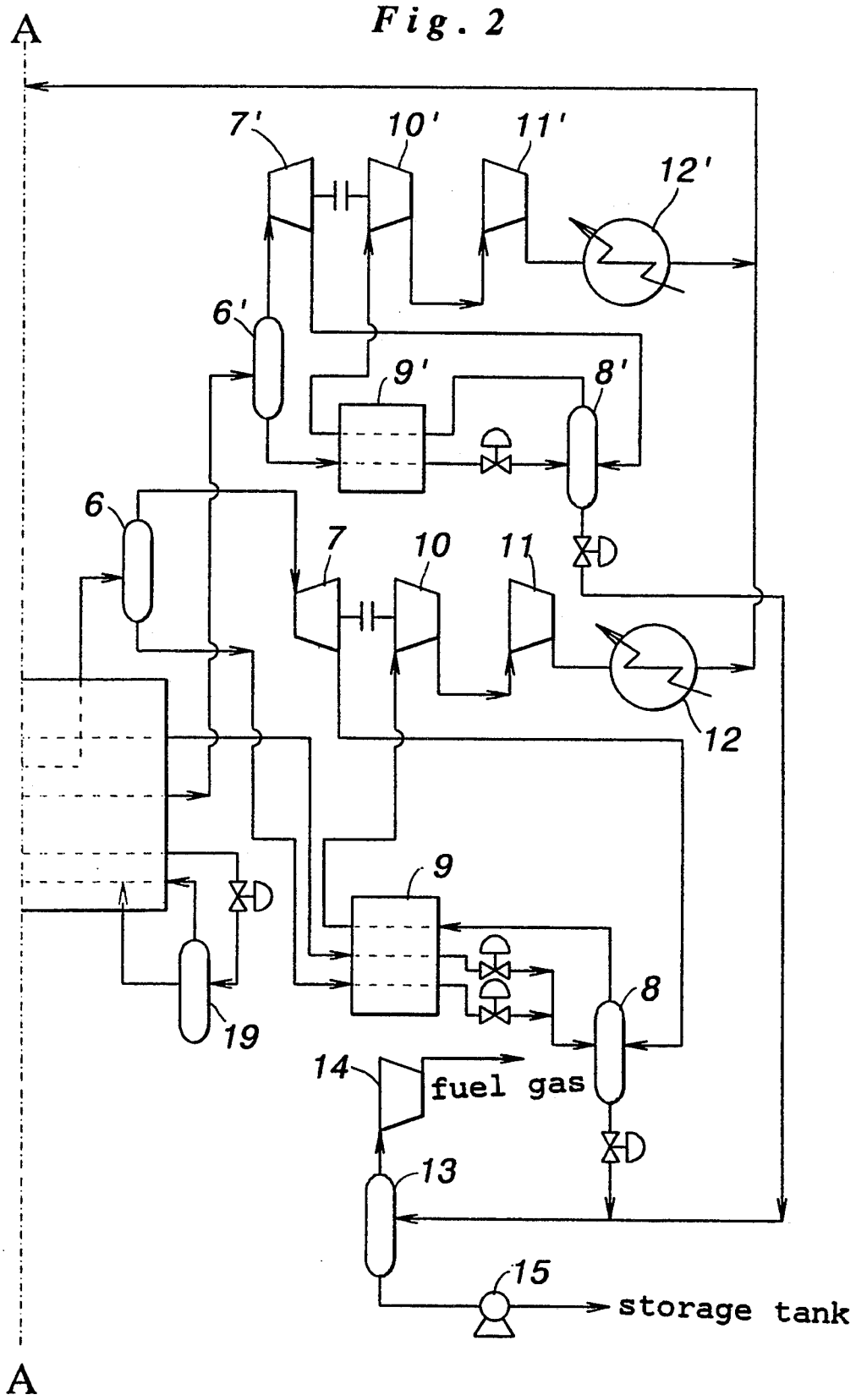
FIG. 2 is a diagram showing the other half of the plant which is suitable for applying the first embodiment of the method for liquefying natural gas according to the present invention.

FIG. 1 shows a first embodiment of the method for liquefying natural gas according to the present invention.

High pressure natural gas from which acid gases such as $CO_2$ and $H_2S$ are removed is introduced into a plate-fin heat exchanger 1 as feed gas *1 at 44 bar and 35° C. The composition of the feed gas is as given in the following:

TABLE 1

| Composition of the Feed Gas (mol %) | |
|---|---|
| $N_2$ | 0.05 |
| $C_1$ | 98.52 |
| $C_2$ | 4.93 |
| $C_3$ | 2.81 |
| $C_4$ | 1.22 |
| $C_{5+}$ | 0.47 |
| total | 100.00 |
| flow rate 18,270 kg-mol/h | |

In the plate-fin heat exchanger 1, the feed gas is cooled to approximately 20° C. by a mixed refrigerant, and most of its water content is condensed and separated in a separation drum 2. The water content is further reduced in a dryer 3 below 1 wt ppm, and the natural gas is returned to the plate-fin heat exchanger 1 to be cooled to −24 ° C. by the mixed refrigerant. The output from the plate-fin heat exchanger 1 is then fed to a heavy fraction separation tower 4 where a heavy fraction is separated from the natural gas for the purpose of removing a $C_{5+}$fraction which freezes at the temperature of LNG or −160° C.

The overhead of the reflux from the separation tower 4 is cooled in the plate-fin heat exchanger 1, and the liquid content thereof is separated in a reflux drum 5 and recycled while the vapor from the reflux drum 5 is cooled in the plate-fin heat exchanger 1 to approximately −73° C. by the mixed refrigerant so as to be partially liquefied (approximately 30 wt %), and fed to an expander inlet drum 6.

The heavy fraction separated in the separation tower 4 contains methane, ethane, propane, butane and so forth, and they are recovered in a distillation section. Methane and ethane are separated in an ethane removal tower, and propane and butane are separated in a propane removal tower and a butane removal tower, respectively. So that the latter two compounds may be mixed with LNG, the propane and butane are combined at the ambient temperature, and this mixed gas stream 2 is introduced into the plate-fin heat exchanger 1 where it is cooled to −24° C. in the same way as the feed natural gas, and joined with the methane-ethane stream *4 from the ethane removal tower. The mixed stream then leaves the plate-fin heat exchanger 1 after being cooled to −73° C. This stream is called the re-injection stream. Stream *3 is introduced into a reflux condenser of the ethane removal tower at 0° C., and is cooled to −23 ° C.

The non-liquefied part of the natural gas separated in the expander inlet drum 6 is expanded to 3 bar and cooled to −143° C. as an isentropic expansion process in a turbo expander 7, and is fed to an expander outlet drum 8 in a partially liquefied condition (approximately 21 wt %). The separated non-liquefied natural gas then exchanges heat, in a plate-fin heat exchanger 9, with the liquid part separated in the expander inlet drum 6 and the re-injection stream from the plate-fin heat exchanger 1, cooling the latter streams to −141° C. while the separated non-liquified natural gas is warmed to −76° C. The latter stream is then pressurized to 8 bar by a compressor 10 directly connected to the expander 7. The latter flow is further pressurized by a recycle compressor 11 to 42 bar, and after being cooled to 32° C. by an after-cooler 12, it is introduced again into the plate-fin heat exchanger 1 to be cooled to approximately −86° C. by the mixed refrigerant.

The stream is partly liquefied (approximately 23 wt %) in a similar manner as the feed natural gas, and is introduced into an expander inlet drum 6'. The non-liquefied natural gas separated in this drum is expanded to 3 bar and cooled to −147° C. in a turbo expander 7' as a substantially isentropic expansion process, and the stream expelled from the expander, which is partly (approximately 26 wt %) liquefied, is introduced into an expander outlet drum 8'. The non-liquefied natural gas separated in this drum exchanges heat with the liquid part separated in the expander inlet drum 6' in a plate-fin heat exchanger 9' where the separated liquid is cooled to −144° C. while the non-liquefied natural gas itself is warmed to −88° C., and is thereafter pressurized to 7.6 bar by a compressor 10' directly connected to the expander 7'. The stream from the outlet of the compressor 10' is further pressurized to 42 bar by a recycle compressor 11', and is cooled to 32° C. in an after-cooler 12' before it is merged with the aforementioned recycle stream.

The liquid cooled in the plate-fin heat exchanger 9 is depressurized by a valve, and is then introduced into the expander outlet drum 8.

The liquid cooled in the plate-fin heat exchanger 9' is also depressurized by a valve, and is introduced into the expander outlet drum 8'. The stream out of the expander outlet drums 8 and 8' is depressurized to 1.3 bar and cooled to −157° C., and is separated into LNG and lean gas in a flash drum 13. The lean gas is pressurized by a compressor 14 at the rate of 5,600 $Nm^3$, and is used as fuel gas. The liquid separated in the flash drum 13 is pumped into a storage tank by a pump 15 at the rate of 305 tons per hour.

Meanwhile, the refrigeration cycle for the mixed refrigerant operates as described in the following.

The low pressure mixed refrigerant which has been warmed and evaporated in the plate-fin heat exchanger 1 has the composition given in Table 2, and leaves the heat exchanger at 30° C. and 3.4 bar. This stream is compressed to 26 bar and heated to 130° C. in the turbo compressor 16. The compressed mixed refrigerant is cooled in an after-cooler 17 by sea water or the like to 32° C., and 66 wt % thereof is liquefied. The liquefied mixed refrigerant is separated into vapor and liquid in a gas/liquid separation drum 18.

TABLE 2

| Composition of the Mixed Refrigerant (mol %) | |
|---|---|
| $C_1$ | 13.96 |
| $C_2$ | 48.85 |
| $C_3$ | 7.18 |
| $iC_4$ | 6.16 |
| $nC_4$ | 9.95 |
| $iC_5$ | 13.91 |
| total | 100.00 |
| flow rate 32,500 kg-mol/h | |

According to the Inventors' analysis, the preferred range of the composition (mol %) of the mixed refrigerant is as given in the following.

TABLE 3

| Composition of the Mixed Refrigerant (mol %) | |
|---|---|
| $N_2$ | 0–10 |
| $C_1$ | 7–60 |
| $C_2$ | 25–80 |
| $C_3$ | 3–20 |
| $C_4$ | 7–30 |
| $C_5$ | 7–30 |

The separated vapor of the high temperature mixed refrigerant is cooled and liquefied in the plate-fin heat exchanger 1 by the low pressure mixed refrigerant as it flows through the heat exchanger. The temperature at the outlet end of the heat exchanger is −86° C. When this high pressure mixed refrigerant liquid is depressurized to 3.8 bar with a J-T valve, a part thereof evaporates, and the stream is turned into a stream of gas/liquid mixed phases at the temperature of −100° C. It is then separated into gas and liquid in a gas/liquid separation drum 19, and is distributed into different paths in the plate-fin heat exchanger 1 so as not to reduce the performance of the plate-fin heat exchanger 1. The distributed mixed refrigerant cools other streams in the heat exchanger 1, and is evaporated and warmed to the temperature of −49° C. before it is introduced into a gas/liquid separation drum 20 after leaving the plate-fin heat exchanger 1.

The high pressure mixed refrigerant expelled from the gas/liquid separation drum 18 is introduced into the plate-fin heat exchanger 1 where the stream is subcooled to −47° C., and after flowing out of the heat exchanger 1, is depressurized to 3.6 bar with a J-T valve, and turned into gas and liquid mixed phases with a part thereof being evaporated. This stream is then introduced into the gas and liquid separation drum 20 along with the aforementioned low pressure mixed refrigerant, and is separated into gas and liquid. The mixed phase stream is then distributed evenly to different paths of the plate-fin heat exchanger 1 so as not to lower the performance of the plate-fin heat exchanger 1.

The distributed mixed refrigerant is warmed and evaporated as it cools other streams, and after being expelled from the plate-fin heat exchanger 1, is returned to the turbo compressor 16. This concludes the recycling process.

It is advantageous to separate the plate-fin heat exchanger 1 into two parts, one upstream of the gas/liquid separation drum 20 and the other downstream thereof. This separation allows each part of the heat exchanger to be optimally designed and reduces the size of the heat exchanger.

The power required for the expanders and the compressors used in the present embodiment are listed in Table 4. The low power consumption levels of compressors 11 and 11' were achieved as a result of providing an inter-cooler.

TABLE 4

| Power consumption (kW) | |
|---|---|
| expander 7 | 7,200 |
| expander 7' | 8,600 |
| compressor 11 | 16,000 |
| compressor 11' | 21,200 |
| compressor 16 | 58,100 |

Figure 3:
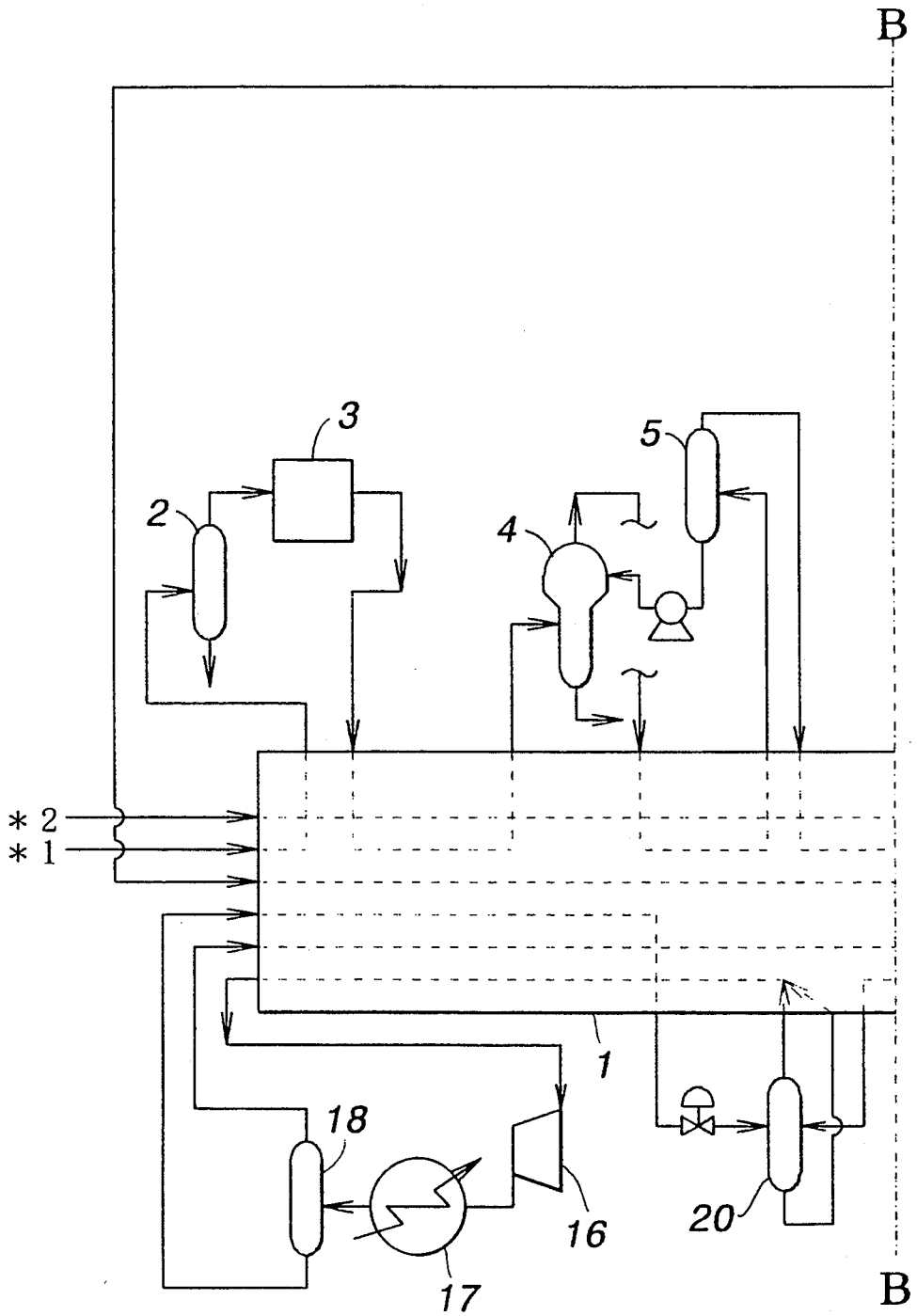
FIG. 3 is a diagram showing one half of a plant which is suitable for applying a second embodiment of the present invention.
Figure 4:
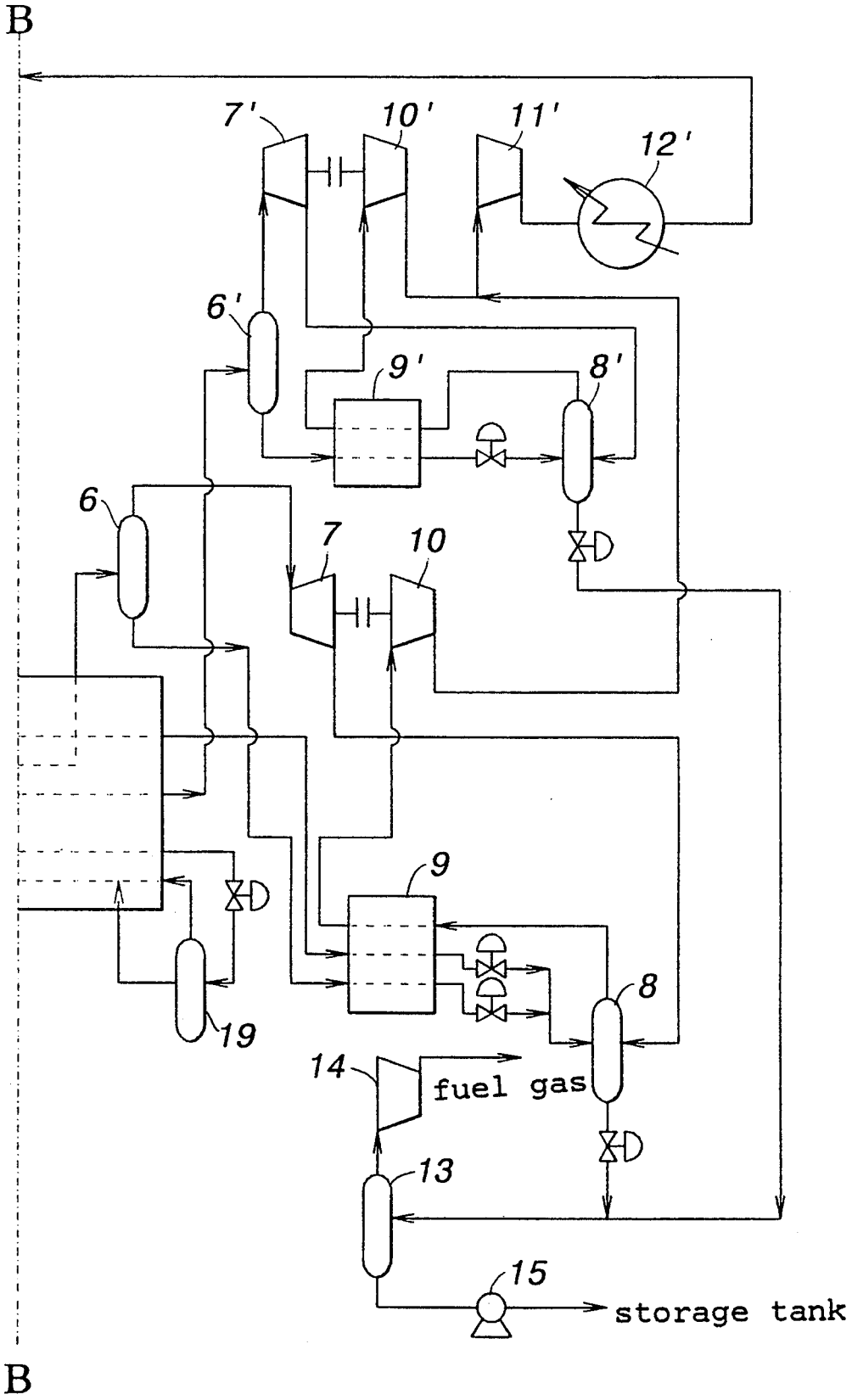
FIG. 4 is a diagram showing the other half of the plant which is suitable for applying the second embodiment of the present invention.

FIGS. 3 and 4 show a second embodiment of the present invention, and in this and the following embodiments, the parts corresponding to those of the first embodiment are denoted with like numerals without repeating the description. In this case, the output pressures of the expanders 7 and 7' are appropriately selected so as to equalize the output pressures of the expander/compressors 10 and 10', respectively, with the result that the recycle compressors 11 and 11' of the first embodiment may be integrated into one and the same compressor. By setting the output pressure of the compressor 11 at a relatively low level, the compressor 11' may be constructed as one having a single casing.

Figure 5:
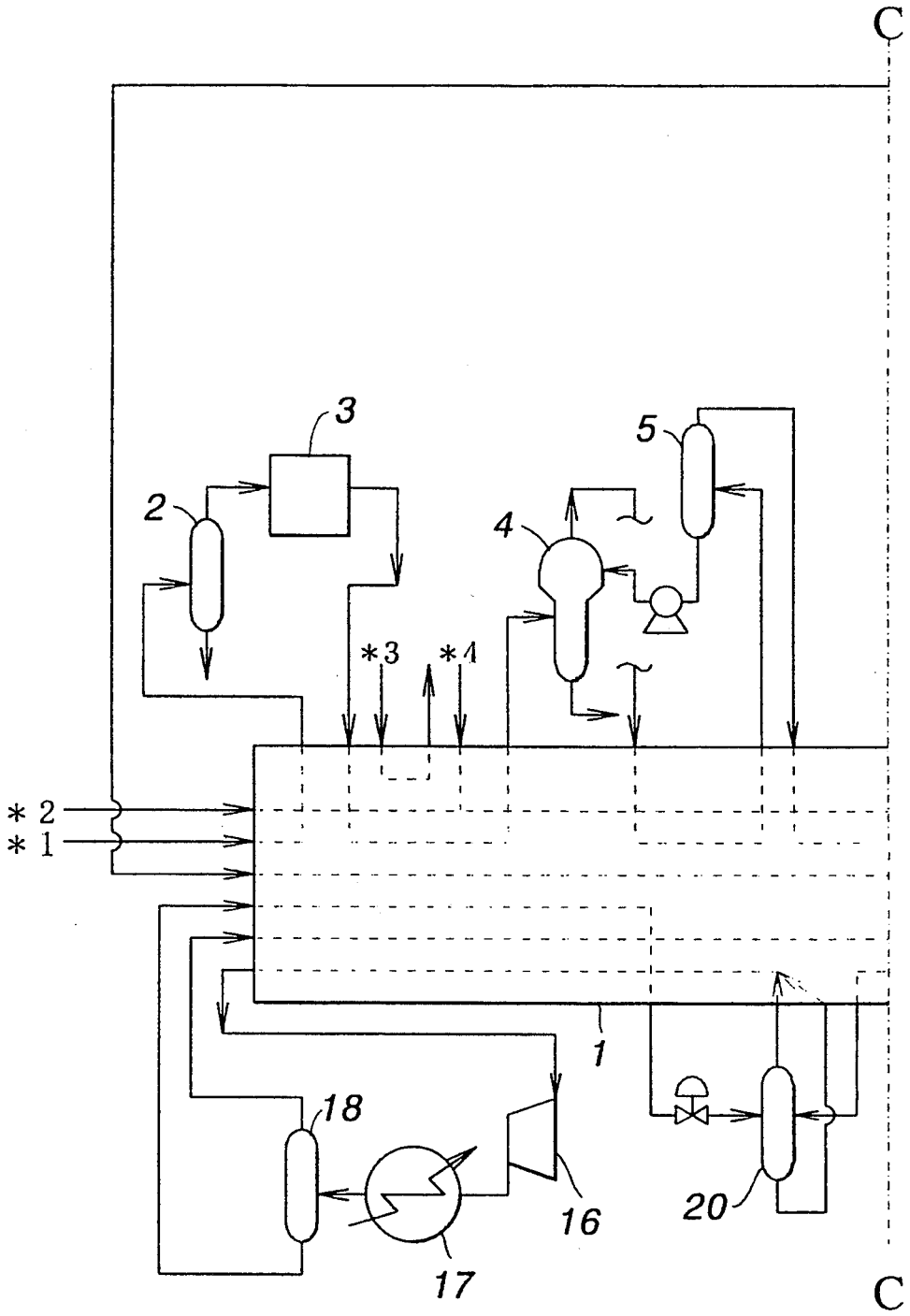
FIG. 5 is a diagram showing one half of a plant which is suitable for applying a third embodiment of the present invention.
Figure 6:
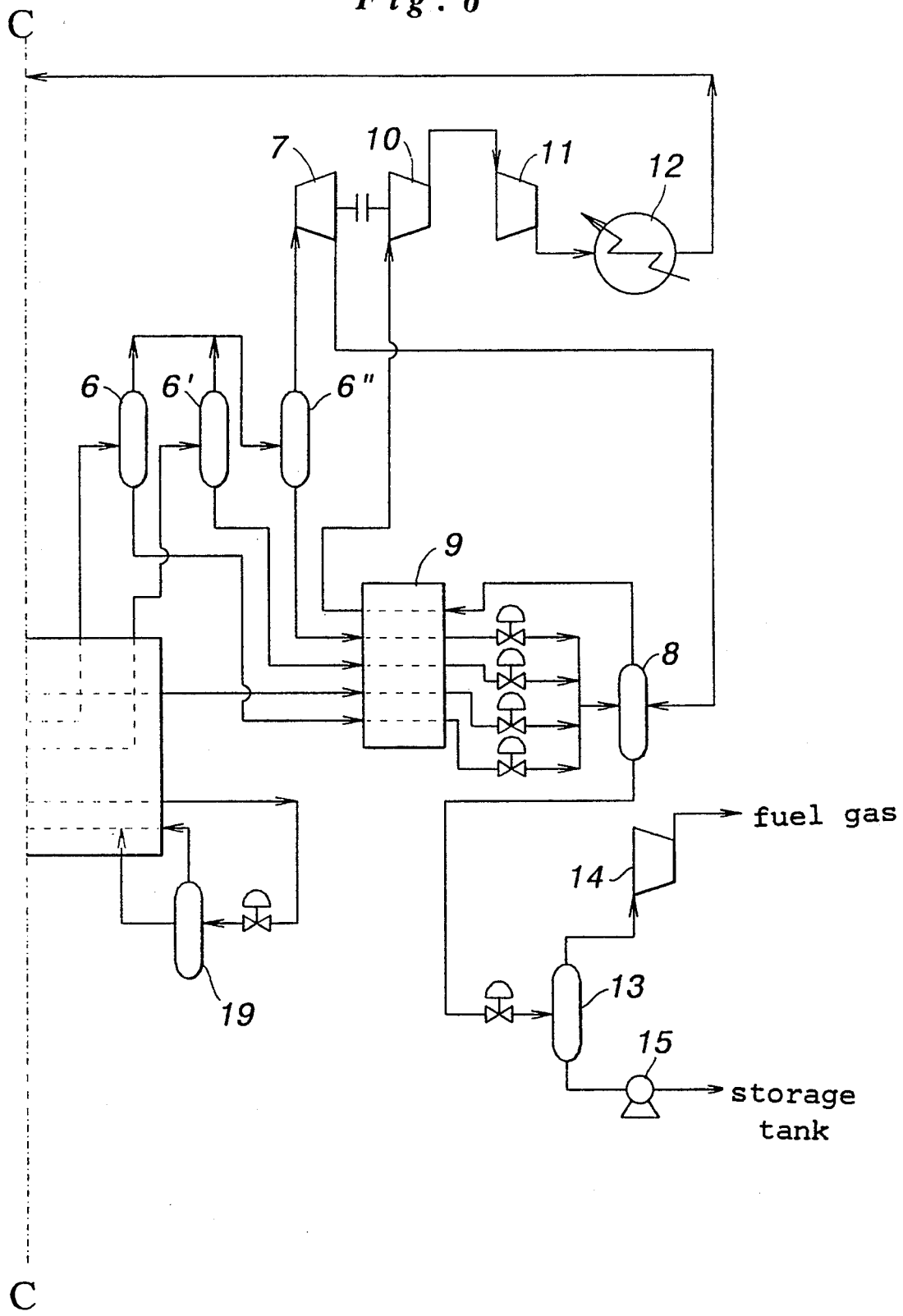
FIG. 6 is a diagram showing the other half of the plant which is suitable for applying the third embodiment of the present invention.

FIGS. 5 and 6 show a third embodiment of the present invention. In this case, the pressure of the recycle gas system is raised to the level of the pressure of the feed gas system so that the expanders 7 and 7' for the feed gas system and the recycle gas system may be integrated into one and the same expander, and the recycle compressors 11 and 11' may be likewise integrated into a common compressor. The plate-fin heat exchangers 9 and 9' may also be combined into a single plate-fin heat exchanger 9.

Figure 7:
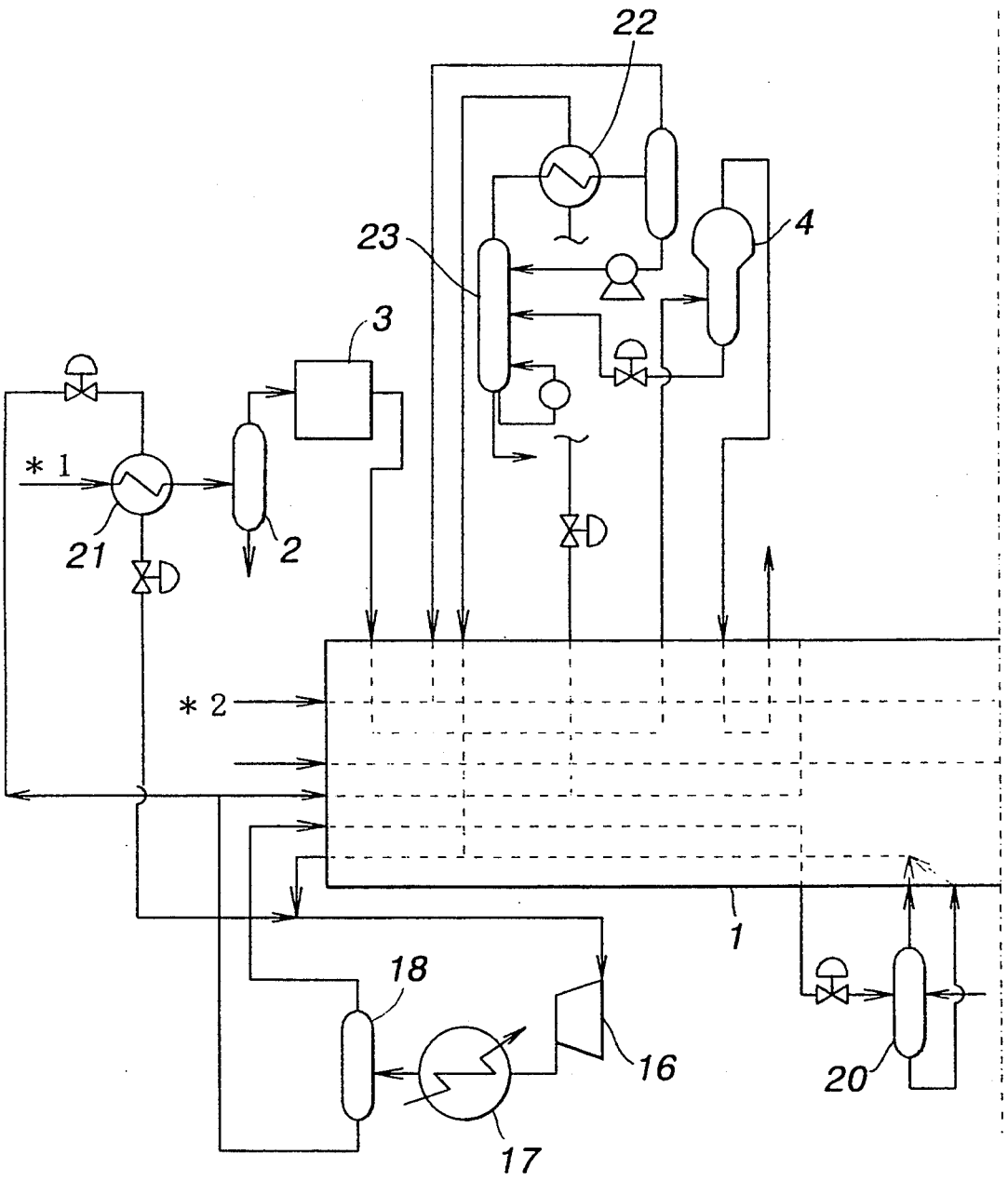
FIG. 7 is a diagram showing an essential part of a plant which is suitable for applying a fourth embodiment of the present invention.

FIG. 7 shows a fourth embodiment of the present invention. When the temperature of the feed natural gas must be rigorously controlled as it is cooled in the process preceding the dryer, a separate heat exchanger 21 may be provided so that the vapor pressure of the high pressure mixed refrigerant may be controlled by using a part of the liquid content thereof. A reflux condenser 22 can be provided separately from the heat exchanger. This reflux condenser 22 uses a part of the liquid component of the high pressure mixed refrigerant subcooled in the plate-fin heat exchanger 1.

Figure 8:
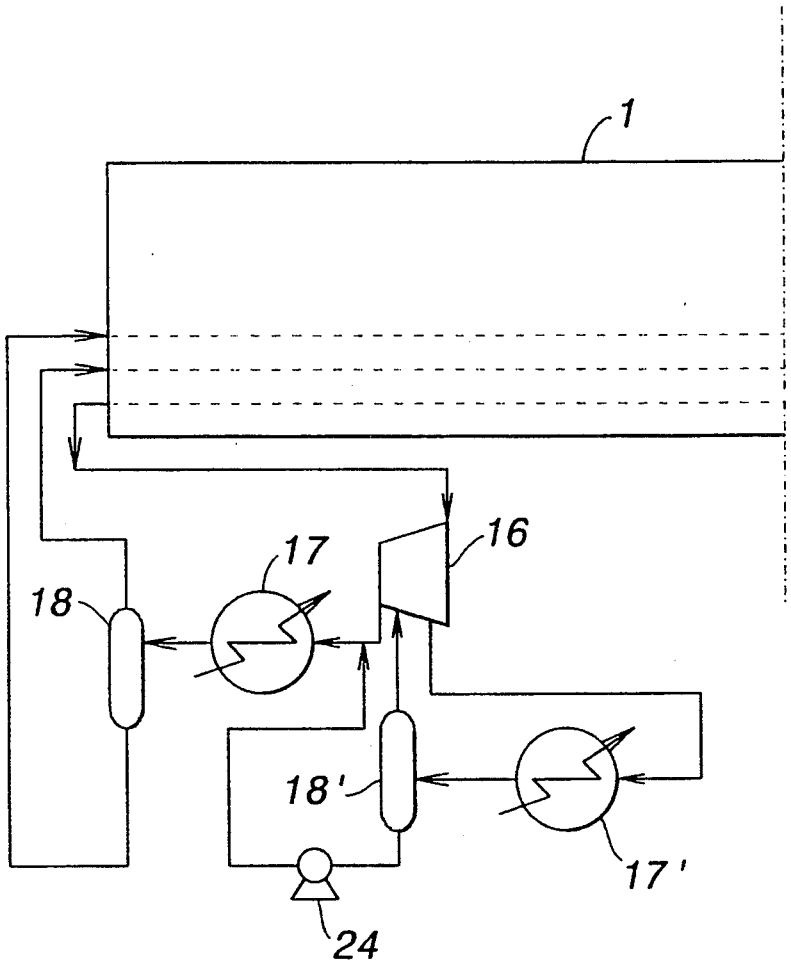
FIG. 8 is a diagram showing an essential part of a plant which is suitable for applying a fifth embodiment of the present invention.

FIG. 8 shows a fifth embodiment of the present invention. In this case, for the purpose of reducing the power requirement by the refrigerant compressor 16, an inter-cooler 17' is used. A part of the mixed refrigerant liquefies in the inter-cooler 17', and this liquid part is separated by a separation drum 18' and pressurized by a pump 24 to be eventually introduced into an after-cooler 17. This embodiment allows reduction in the power consumption.

Figure 9:
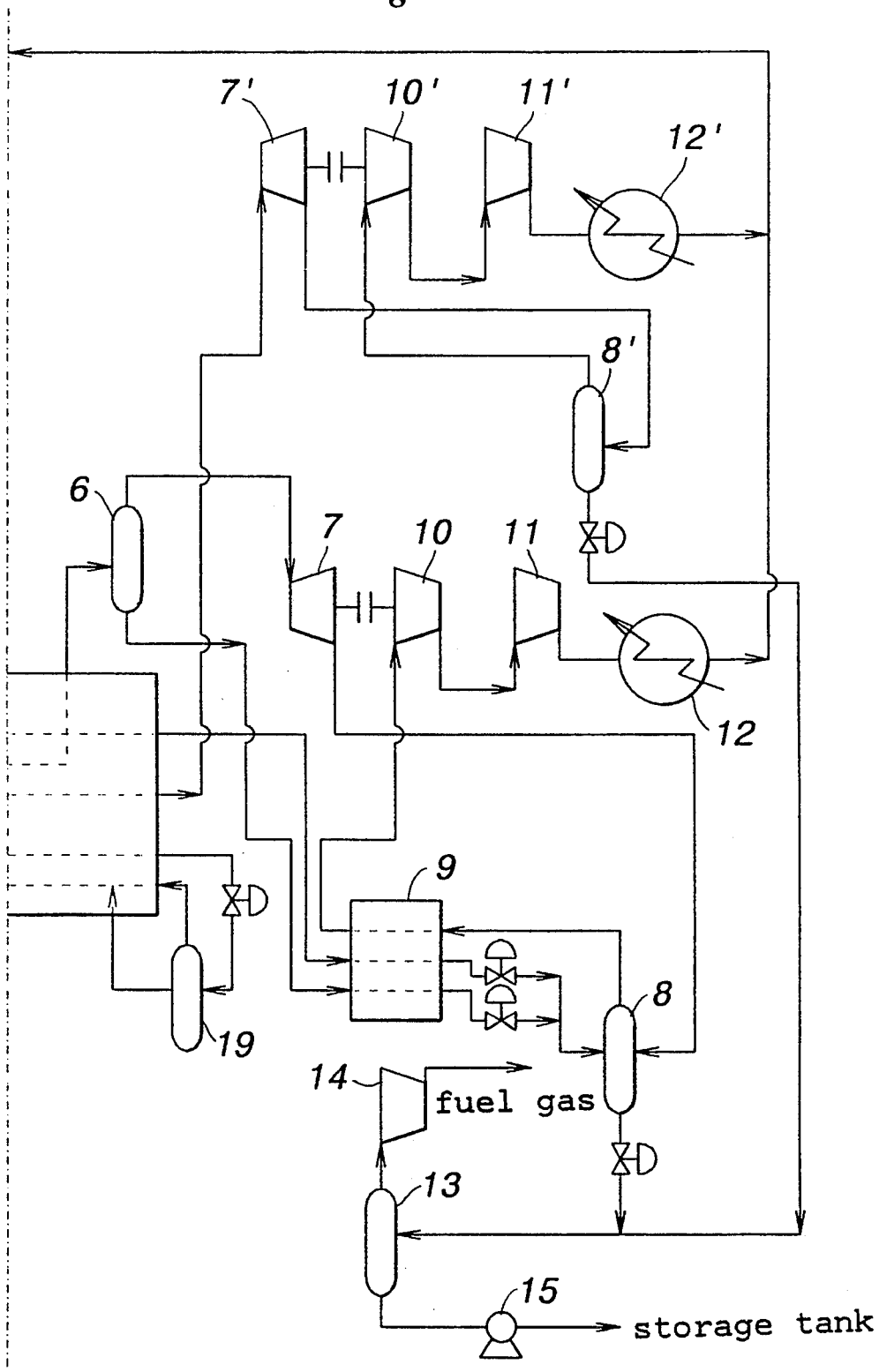
FIG. 9 is a diagram showing an essential part of a plant which is suitable for applying a sixth embodiment of the present invention.

FIG. 9 shows a sixth embodiment of the present invention. This embodiment is substantially similar to the first embodiment, but, since the recycle gas is at a supercritical pressure, partial liquefaction would not take place in the plate-fin heat exchanger, and the natural gas is simply cooled. Therefore, the non-liquefied gas component at the outlet end of the turbo expander 7' for the recycle gas is not warmed by the heat exchanger but is compressed forthwith.

Figure 10:
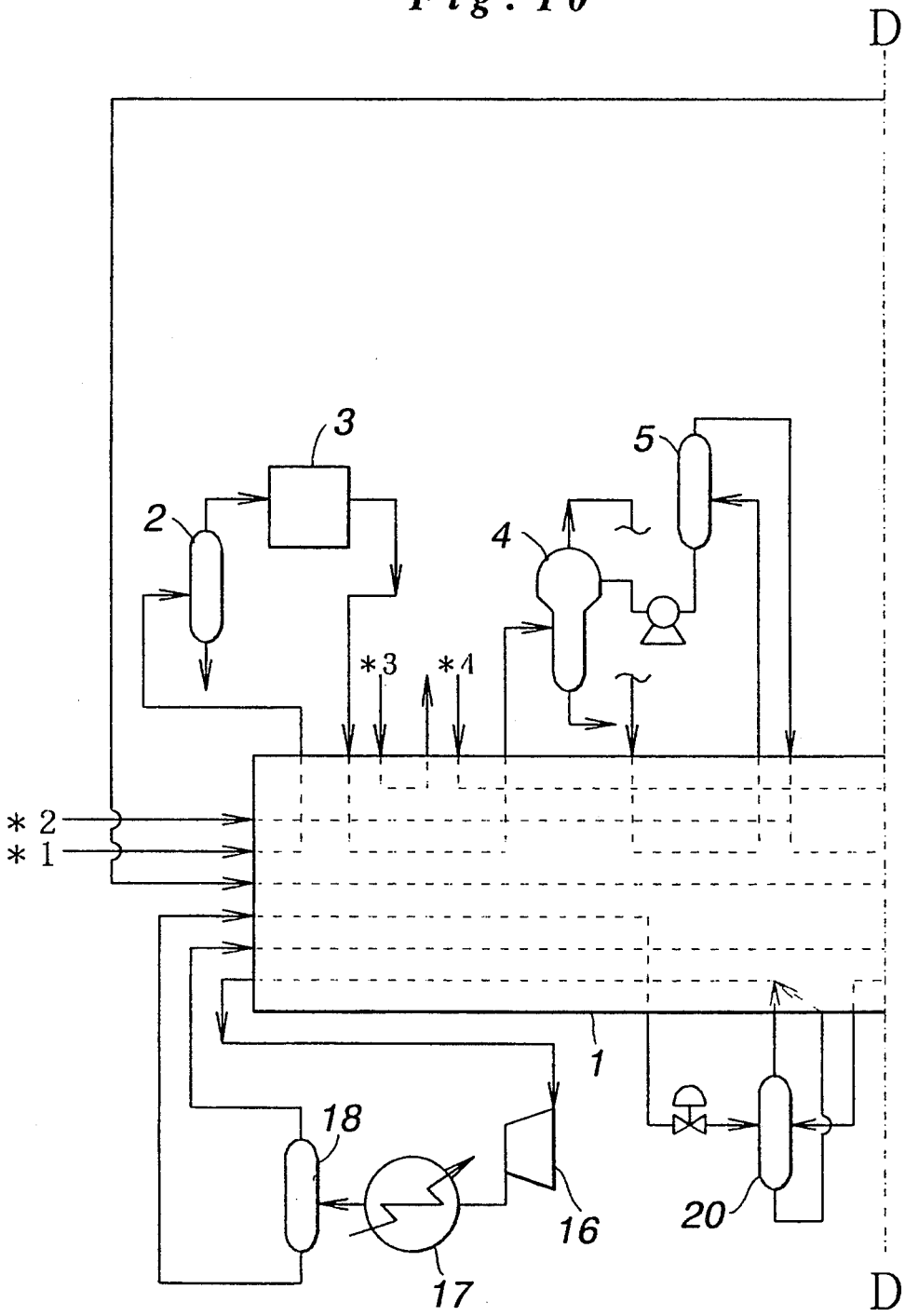
FIG. 10 is a diagram showing one half of a plant which is suitable for applying a seventh embodiment of the present invention.
Figure 11:
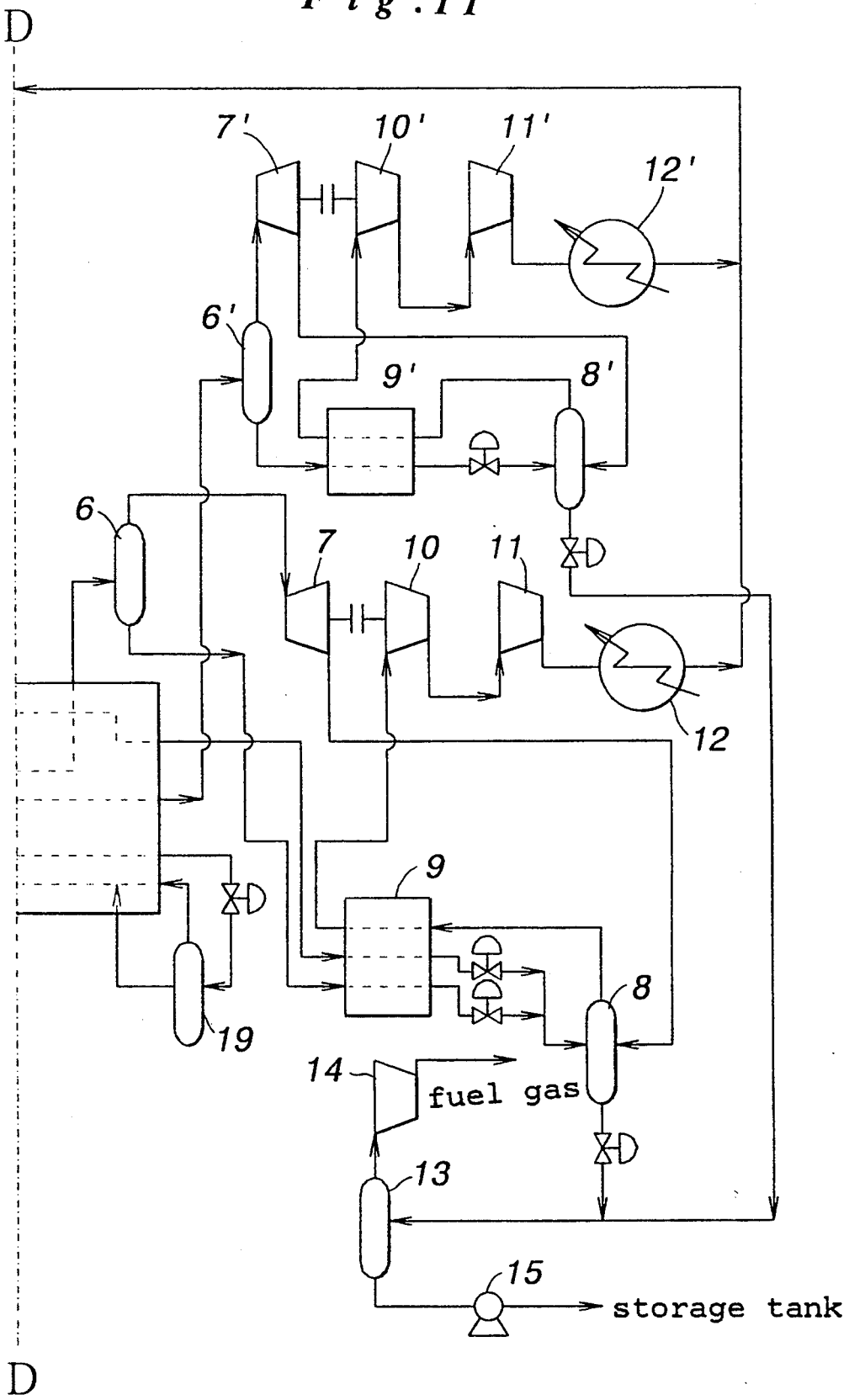
FIG. 11 is a diagram showing the other half of the plant which is suitable for applying the seventh embodiment of the present invention.

FIGS. 10 and 11 show a seventh embodiment of the present invention. This embodiment is substantially similar to the first embodiment, but the propane and butane re-injections are admitted into the outlet of the reflux drum 5, and freezing of normal butane in the plate-fin heat exchanger 9 is avoided. Meanwhile, the methane and ethane from the ethane removal tower is cooled by the plate-fin heat exchanger 9 in the same way as in the first embodiment. This is because of the difficulty in raising the pressure of this stream to the level of the feed natural gas.

Figure 12:
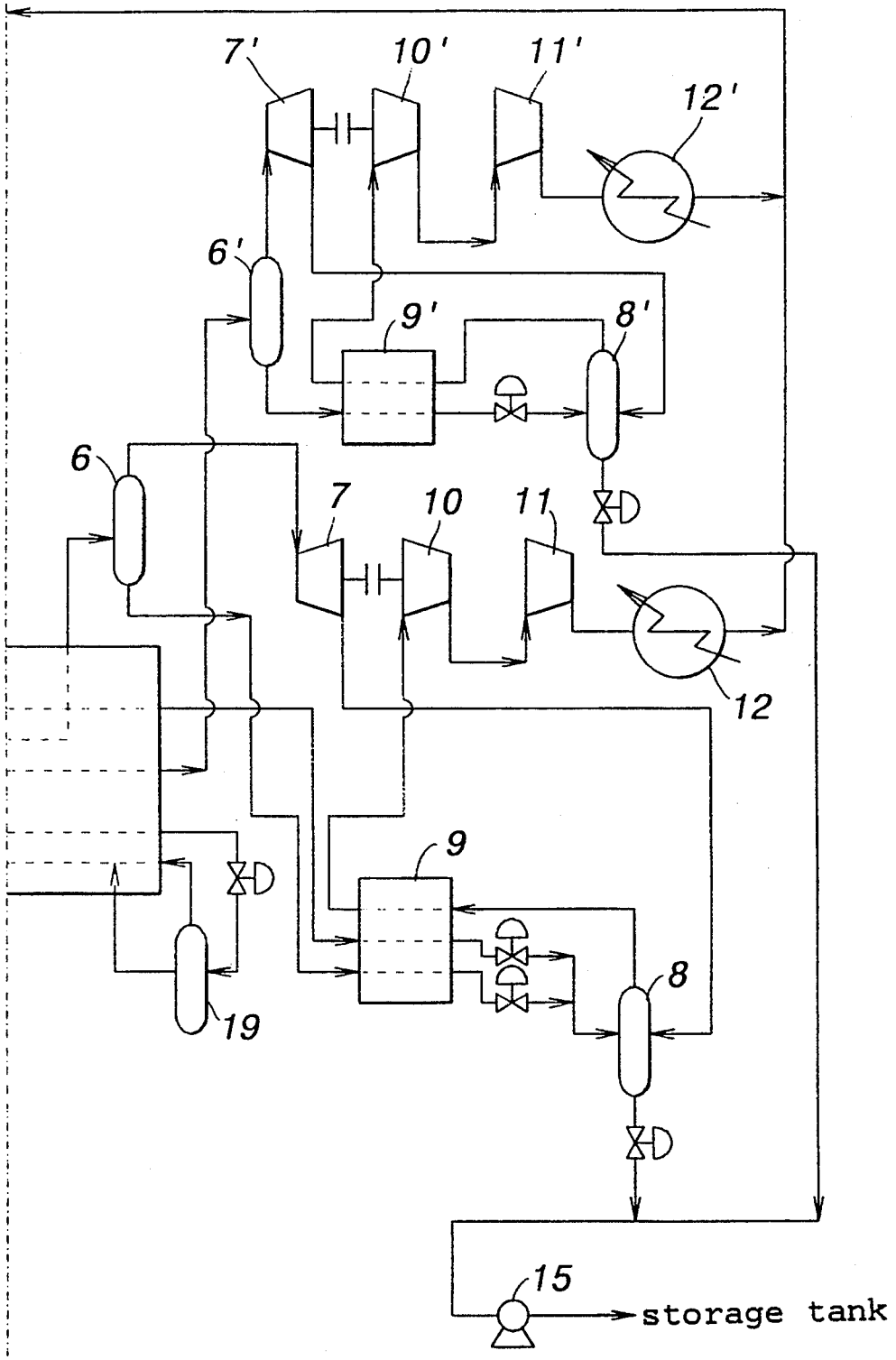
FIG. 12 is a diagram showing an essential part of a plant which is suitable for applying a eighth embodiment of the present invention.

FIG. 12 shows an eighth embodiment of the present invention. In this case, the output pressure of the expander 7 is set substantially equal to the atmospheric pressure, and the fuel gas for the plant is obtained from the feed natural gas or the recycle natural gas. Therefore, the need for the flash drum 13 and the fuel gas compressor 14 is eliminated.

The present invention provides a method for liquefying natural gas which can be readily adapted to LNG plants of all sizes without requiring expensive and special heat exchangers.

Although the present invention has been described in terms of specific embodiments, it is possible to modify and alter details thereof without departing from the spirit of the present invention.

What we claim is:

1. A method for liquefying natural gas, comprising the steps of:

cooling feed natural gas with a refrigerant in a first feed gas stage to produce liquefied and non-liquefied parts of said feed natural gas;

cooling the non-liquefied part of said feed natural gas with a substantially isentropic expansion in a second feed gas stage to produce liquefied and non-liquefied parts of said feed natural gas;

pressurizing and recycling the non-liquefied part of said feed natural gas from said second feed gas stage by using a first compressor to produce a recycle natural gas;

cooling the recycle natural gas with a refrigerant in a first recycle gas stage to produce liquefied and non-liquefied parts of said recycle natural gas;

cooling the non-liquefied part of said recycle natural gas from said first recycle gas stage with a substantially isentropic expansion in a second recycle gas stage to produce liquefied and non-liquefied parts of said recycle natural gas; and recovering the liquefied parts of said feed natural gas and said recycle natural gas;

said first compressor being driven at least partly by power obtained by at least one of said substantially isentropic expansion steps.

2. A method according to claim 1, wherein said cooling steps using a refrigerant comprise the use of a common plate-fin heat exchanger.

3. A method according to claim 1 further comprising the step of exchanging heat between the liquefied part of said feed natural gas from said first feed gas stage and the non-liquefied part of said feed natural gas from said second feed gas stage.

4. A method according to claim 1 further comprising the step of exchanging heat between the liquefied part of said recycle natural gas from said first recycle gas stage and the non-liquefied part of said recycle natural gas from said second recycle gas stage.

5. A method according to claim 1, wherein said first feed gas stage and said first recycle gas stage each comprise a stage for cooling the natural gas from a start temperature to an intermediate temperature lower than said start temperature; and said second feed gas stage and said second recycle gas stage each comprise a stage for cooling the natural gas from said intermediate temperature to a final temperature at which the natural gas is liquefied.

6. A method according to claim 1, further comprising the steps of pressurizing and recycling the non-liquefied part of said recycle natural gas from said second recycle gas stage by using a second compressor.

7. A method according to claim 6, wherein said second compressor is driven at least partly by power obtained by at least one of said substantially isentropic expansion steps.

8. A method according to claim 6, wherein said first and second compressors comprise a common compressor.

9. A method according to claim 8, wherein said substantial isentropic expansion for said feed natural gas and said recycle natural gas is carried out in a common turbo expander.

10. A method according to claim 8, wherein said substantial isentropic expansion for said feed natural gas and said recycle natural gas is carried out in two separate turbo expanders.

11. A method according to claim 1, wherein the refrigerant is a mixed refrigerant having the composition (mol %):

| | |
|---|---|
| $N_2$ | 0–10 |
| $C_1$ | 7–60 |
| $C_2$ | 25–80 |
| $C_3$ | 3–20 |
| $C_4$ | 7–30 |

-continued

| | |
|---|---|
| $C_5$ | 7–30 |

said method further comprising the steps of:

circulating said mixed refrigerant in a closed loop with a compressor to produce a pressurized refrigerant;

partly liquefying said pressurized refrigerant with an after-cooler;

separating the partly liquefied refrigerant with a separation drum to produce a gas refrigerant fraction and a first liquid refrigerant fraction;

passing said gas and said first liquid refrigerant fractions in separate paths of a heat exchanger cooled by a low-temperature, low-pressure mixed refrigerant, and thereby liquefying said gas refrigerant fraction to produce a second liquid refrigerant fraction;

passing said second liquid refrigerant fraction through an expansion valve or an expansion drum so as to convert said second liquid refrigerant fraction into a low-temperature, low-pressure mixed refrigerant;

passing said low-temperature, low-pressure mixed refrigerant through said heat exchanger in a direction opposite to that of said gas refrigerant fraction;

mixing said low-temperature, low-pressure mixed refrigerant with said first liquid refrigerant fraction and flowing the combined mixed refrigerant in a direction opposite to that of said gas refrigerant fraction; and recycling said combined mixed refrigerant to the compressor.

12. A method according to claim 11, wherein said heat exchanger comprises a plate-fin heat exchanger.

* * * * *